US007437110B2

(12) United States Patent
Kondo et al.

(10) Patent No.: US 7,437,110 B2
(45) Date of Patent: Oct. 14, 2008

(54) FIXING DEVICE

(75) Inventors: Akihiro Kondo, Osaka (JP); Naoyuki Ishida, Osaka (JP); Syoukou Gon, Hyogo (JP)

(73) Assignee: Kyocera Mita Corportation, Osaka (JP)

( * ) Notice: Subject to any disclaimer, the term of this patent is extended or adjusted under 35 U.S.C. 154(b) by 0 days.

(21) Appl. No.: 11/674,473

(22) Filed: Feb. 13, 2007

(65) Prior Publication Data

US 2007/0189818 A1 Aug. 16, 2007

(30) Foreign Application Priority Data

Feb. 13, 2006 (JP) ..... 2006-034696
Feb. 28, 2006 (JP) ..... 2006-054117
Feb. 28, 2006 (JP) ..... 2006-054118

(51) Int. Cl.
*G03G 15/20* (2006.01)

(52) U.S. Cl. ..... 399/320; 399/122; 399/336; 219/216

(58) Field of Classification Search ..... 399/33, 399/122, 320, 328, 329, 330, 331, 332, 336
See application file for complete search history.

(56) References Cited

U.S. PATENT DOCUMENTS 5,765,086 A * 6/1998 Kishino et al. ..... 399/329
6,782,230 B2 * 8/2004 Yaomin et al. ..... 399/326

FOREIGN PATENT DOCUMENTS

JP 2004-062053 A 2/2004
JP 2004-094146 A 3/2004

* cited by examiner

*Primary Examiner*—David M. Gray
*Assistant Examiner*—G. M. Hyder
(74) *Attorney, Agent, or Firm*—Global IP Counselors, LLP

(57) ABSTRACT

A fixing device 100 includes a fixing belt 102, a heat source 105, a support member 104, a pressure roller 103, and a reinforcing member 106. The fixing belt 102 has a metal sleeve. The heat source 105 is provided within the fixing belt 102. The support member 104 has a contact surface 104*a* that is in sliding contact with the inside surface of the fixing belt 102. The pressure roller 103 forms a nip with the bottom surface 104*a* between which the fixing belt 102 is sandwiched and pressed. The pressure roller 103 drives the fixing belt 102 to rotate. The reinforcing member 106 has a surface contacting the support member 104 on which a plurality of irregularities is formed. The reinforcing member 106 is positioned on a side opposite the support member to the bottom surface 104*a*, and receives a pressure force applied by the pressure roller 103.

20 Claims, 15 Drawing Sheets

FIXING DEVICE

CROSS-REFERENCE TO RELATED APPLICATIONS

This application claims priority to Japanese Patent Application Nos. 2006-034696, 2006-054118, and 2006-054117 respectively filed on Feb. 13, 2006, Feb. 28, 2006, and Feb. 28, 2006. The entire disclosures of Japanese Patent Application Nos. 2006-034696, 2006-054118, and 2006-054117 are hereby incorporated herein by reference.

BACKGROUND OF THE INVENTION

1. Field of the Invention

The present invention generally relates to a fixing device. More specifically, the present invention relates to a fixing device used to fix a toner image onto a recording sheet that is provided in image forming devices such as photocopiers or the like.

2. Background Information

In image forming devices such as photocopiers, printers, facsimiles, and so on that use electrophotographic technology, toner images formed on an image carrier such as a photosensitive drum are transferred onto a transfer material (transfer medium) such as a recording sheet. Then the toner image that has been transferred onto the sheet is fixed using a method of applying heat and pressure to the sheet.

A fixing device that uses this fixing method includes an endless fixing belt that circulates as a heating member, and a pressure member (which is normally a roller) that is in opposition to the endless fixing belt. When fixing a toner image, a recording sheet is inserted into and made to pass through a fixing nip between the fixing belt and the pressure member. Heat from a radiant heat source provided on the inside of the fixing belt as a heating member and pressure from the pressure roller are applied to the recording sheet to which the toner image has been transferred.

Here the heating member, which is the fixing belt, is formed from a flexible sheet material, so a support member is provided on the inside of the fixing belt to take the pressure of the pressure member. The support member has a sliding contact surface that is in sliding contact with the inside of the heating member so that the sliding contact surface slides on the heating member (see Japanese Patent Application Laid-open No.2004-62053 and Japanese Patent Application Laid-open No.2004-94146).

Also, for example, a halogen lamp is provided as the radiant heat source so that the heating member is heated by the radiant heat of the halogen lamp. On the other hand, the support member needs the strength to withstand the pressure of the pressure roller so the support member is normally large and made from a metal material whose heat capacity is large.

However, if for example the support member was a plate, the plate thickness would have to be large. Therefore the heat capacity of the support member would become large, and the support member would absorb a large quantity of the heat of the heated heating member, and it would become difficult to heat the heating member.

When the heat to raise the temperature of the heating member is transferred to the support member is this way, a large quantity of heat is needed to raise the temperature of the heating member to a predetermined temperature. This creates an energy efficiency problem as well as lengthening the warm-up time. Also, as a result of transferring the heat to raise the temperature of the heating member to the support member, it is not possible to transfer sufficient heat to the surface of recording sheets, which can lead to defective fixing.

In view of the above, it will be apparent to those skilled in the art from this disclosure that there exists a need for an improved fixing device. This invention addresses this need in the art as well as other needs, which will become apparent to those skilled in the art from this disclosure.

SUMMARY OF THE INVENTION

It is an object of the present invention to provide a fixing device in which the support member has the strength to withstand the pressure of the pressure member and for which the quantity of heat taken from the heating member is as small as possible so that the warming-up time is shortened, and fixing defects due to insufficient heating are prevented. Further, in recent years further energy efficiency has become desirable in film heating type fixing devices. Therefore consideration is being given to making the support member that presses against the pressure roller via the film smaller and thinner. However, if the support member is simply made smaller and thinner there is a danger that the support member will deform due to the pressure of the pressure roller, the film will become skewed, and wrinkles could occur.

It is also an object of the present invention to provide a film heating type fixing device using a support member that is smaller and thinner than that of the conventional art, and for which the support member will not deform due to the pressure of the pressure roller. Further, it is a separate object of the present invention to improve the thermal efficiency of the fixing device, to make the fixing device energy efficient, and at the same time to prevent the occurrence of skewing and wrinkles in the film.

A fixing device according to a first aspect of the present invention has an endless loop shaped heating member, a heating source, a support member, a pressure member, and a reinforcing member. The heating source is disposed within the heating member. The support member has a contact surface that can contact an inside surface of the heating member. The pressure member contacts the part of the heating member that corresponds to the part that contacts the contact surface of the support member. The reinforcing member is provided to reinforce the support member.

A fixing device according to a second aspect of the present invention is the fixing device according to the first aspect, wherein the support member and the reinforcing member are formed integrally.

A fixing device according to a third aspect of the present invention is the fixing device according to the first aspect, wherein the thickness of the reinforcing member is greater than the thickness of the support member.

A fixing device according to a fourth aspect of the present invention is the fixing device according to the first aspect, wherein the base material of the heating member is a metal sleeve. The pressure member forms a nip with the contact surface of the support member between which the heating member is sandwiched and pressed, and the pressure member drives the heating member to rotate in a predetermined direction. The reinforcing member has a contact surface in which a plurality of irregularities is formed that contacts the support member, that receives the pressure force of the pressure member applied to the support member in a position on the opposite side to the contact surface of the support member.

A fixing device according to a fifth aspect of the present invention is the fixing device according to the fourth aspect, wherein a plurality of spherical-shaped projections is formed on the contact surface of the reinforcing member.

A fixing device according to a sixth aspect of the present invention is the fixing device according to the fourth aspect, wherein a plurality of rib-shaped projections extending in the rotation direction of the heating member is formed in the contact surface of the reinforcing member.

A fixing device according to a seventh aspect is the fixing device according to the first aspect, further including thermal insulation material placed between the support member and the reinforcing member.

A fixing device according to an eighth aspect of the present invention is the fixing device according to the seventh aspect, wherein the thermal insulation material is a heat resistant resin or silicone rubber.

A fixing device according to a ninth aspect is the fixing device according to the first aspect, wherein the reinforcing member has a plate shaped member that contacts a surface of the support member, and a plate shaped rib disposed on the rear or upper surface of the plate shaped member in approximately the center of the plate shaped member in the width direction and at right angles to the plate shaped member.

A fixing device according to a tenth aspect of the present invention is the fixing device according to the fourth aspect, wherein the reinforcing member has a plate shaped member that contacts a surface of the support member and a plate shaped rib disposed on the rear or upper surface of the plate shaped member in approximately the center of the plate shaped member in the width direction and at right angles to the plate shaped member.

A fixing device according to an eleventh aspect of the present invention is the fixing device according to the seventh aspect, wherein the reinforcing member has a plate shaped member that contacts a surface of the support member and a plate shaped rib disposed on the rear or upper surface of the plate shaped member in approximately the center of the plate shaped member in the width direction and at right angles to the plate shaped member.

A fixing device according to a twelfth aspect of the present invention is the fixing device according to the first aspect, wherein the base material of the heating member is a metal sleeve. The pressure member forms a nip with the contact surface of the support member between which the heating member is sandwiched and pressed, and the pressure member drives the heating member to rotate in a predetermined direction. The reinforcing member contacts the support member on the opposite side of the support member to the heating member, and receives the pressure force of the pressure member applied to the support member. At least one of the support member and the reinforcing member is formed either in whole or in part from a thermal insulation material.

A fixing device according to a thirteenth aspect of the present invention is the fixing device according to the twelfth aspect, wherein the reinforcing member has a plate shaped member that contacts a surface of the support member and a plate shaped rib disposed on the rear or upper surface of the plate shaped member in approximately the center of the plate shaped member in the width direction and at right angles to the plate shaped member.

A fixing device according to a fourteenth aspect of the present invention is the fixing device according to the twelfth aspect, wherein the thermal insulation material includes one of poly-etheretherketone (PEEK), polyimide (PI), polyamideimide (PAT), polybenzimidazole (PBI), polytetrafluoroethylene (PTFE), or perfluoro alkoxyl alkane (PFA).

A fixing device according to a fifteenth aspect of the present invention is the fixing device according to the first aspect, wherein the heating member is a cylindrical shaped film that can freely rotate. The heat source is provided within the film and radiates radiant heat. The support member has a contact surface that contacts the inner peripheral surface of the film. The pressure member presses against the contact surface of the support member via the film. The reinforcing member is a plate shaped member that is installed on the surface of the support member opposite the contact surface in the length direction and substantially perpendicular to the support member.

A fixing device according to a sixteenth aspect of the present invention is the fixing device according to the fifteenth aspect, wherein the support member supports the reinforcing member by support portions formed by cutting out a part of the support member.

EFFECT OF THE INVENTION

By providing the strength to resist the pressure force of the pressure member and by minimizing the quantity of heat taken from the heating member, the fixing device according to the present invention can shorten the warming up time, and fixing defects or the like caused by insufficient heating do not easily occur.

Further, in the fixing device according to the present invention, a plate shaped reinforcing member is installed substantially perpendicularly on the surface of the support member opposite to the sliding contact surface. Therefore, even if the support member is made smaller and thinner, it is possible to prevent deformation as a result of the pressure force of the pressure member. In this way it is difficult for film to become skewed and for wrinkles to occur.

Here, stresses and strains due to differences in the coefficient of linear thermal expansion of the support member and the reinforcing member are minimized by supporting the reinforcing member with support portions cut out from a part of the support member. Also, heat transfer from the support member to the reinforcing member is minimized so it is possible to improve the thermal efficiency.

These and other objects, features, aspects, and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

First Embodiment

The following is a detailed explanation of a first preferred embodiment of an image forming device 1 that includes a fixing device 100 according to the present invention.

Figure 1:
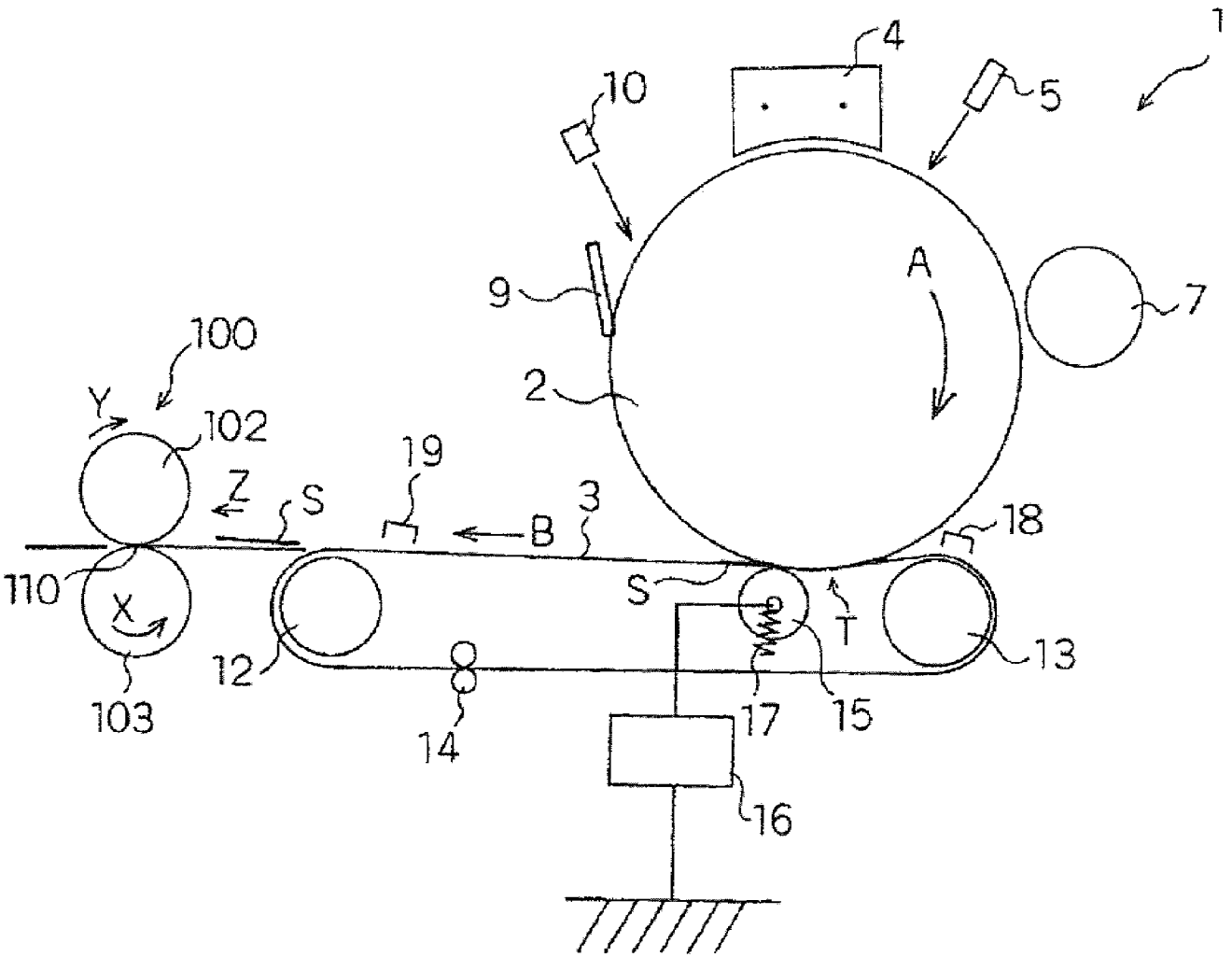
FIG. 1 is a schematic cross-sectional view showing the outline of an image forming device according to a first preferred embodiment of the present invention.

FIG. 1 is a cross-sectional view showing an example of the configuration of a copier that is the image forming device 1. The image forming device 1 includes a photosensitive drum 2 which is an image carrier. A transfer belt 3 that transports recording sheets (transfer media) S is provided below the photosensitive drum 2. The photosensitive drum 2 has a layer of photosensitive material covering the surface of a metal drum, for example, a drum with diameter 80 mm using A-SI photosensitive material. Further, the photosensitive drum 2 rotates in the direction of the arrow A in FIG. 1.

A main charging device 4 that uniformly charges the surface of the photosensitive drum 2, a laser irradiation device 5 that irradiates the photosensitive drum 2 with laser light, and a developing device 7 are disposed around the outer periphery of the photosensitive drum 2 in this order in the direction of rotation of the photosensitive drum 2. Further, a drum cleaner 9 and a photosensitive drum 2 decharger 10 are provided downstream of a position (transfer position) T where a recording sheet S transported by the transfer belt 3 and the photosensitive drum 2 contact in the direction of rotation of the photosensitive drum 2. The decharger 10 is preferably further downstream than the drum cleaner 9.

The laser irradiation device 5 includes a laser light emitting unit, and an optical device including a mirror, lens, and so on. The laser irradiation device 5 irradiates the surface of the photosensitive drum 2 based on image signals from a CCD camera that is not shown in the drawings with laser light, to form an electrostatic latent image on the surface of the photosensitive drum 2.

The developing unit 7 supplies toner from within a toner container to the surface of the photosensitive drum 2, to form a toner image by applying toner to the electrostatic latent image formed on the surface of the photosensitive drum 2.

The transfer belt 3 is an endless belt fitted between a drive roller 12 and a driven roller 13, preferably provided with a resistance controlled NBR base material. Also, a coating of high resistance urethane binder dispersed with PTFE is preferably applied to the transfer belt 3 to improve the adhesion of recording sheets on the surface as well as to ensure the toner release properties of the surface.

The rotation shafts of the drive roller 12 and the driven roller 13 are supported to be mutually parallel, and also parallel with the axis of rotation the photosensitive drum 2. When the drive roller 12 is rotated, the transfer belt 3 circulates at a predetermined speed and in a predetermined direction (the direction of the arrow B in the figure). The speed of rotation (peripheral speed V2) of the photosensitive drum 2, the speed of rotation (peripheral speed V112) of the drive roller 12, the speed of movement (V3) of the transfer belt 3, and the speed of movement (Vs) of the recording sheet S adhering to and supported by the transfer belt 3 are preferably all designed to be the same (V2=V12=V3=Vs). Besides the drive roller 12 and the driven roller 13, a belt cleaner 14 is provided downstream of the drive roller 12 in the direction of circulation of the transfer belt 3 to remove excess toner adhering to the transfer belt 3. Also, a belt charger 18 is provided upstream of the transfer position T of the transfer belt 3 in the direction of circulation of the transfer belt 3, to charge the transfer belt 3 so that recording sheets electrostatically adhere to the transfer belt 3. A decharger 19 is provided downstream of the transfer position T in the direction of circulation or movement of the transfer belt 3 in a position just before the drive roller 12, to remove electric charge from the charged transfer belt 3.

A transfer roller 15 that applies a bias is provided in a position in opposition to the photosensitive drum 2 to sandwich the transfer belt 3 therein. The transfer roller 15 applies a charge to the transfer belt 3 of opposite polarity to that of the toner adhering to the surface of the photosensitive drum 2. As a result of the charge of the transfer belt 3, the toner image formed on the photosensitive drum 2 is transferred from the surface of the transfer belt 3 to the recording sheet S. Further, a high voltage is applied to the transfer roller 15 by a high voltage source 16, and the transfer roller 15 is preferably pressed against the rear surface of the transfer belt 3 by a spring 17.

Figure 2:
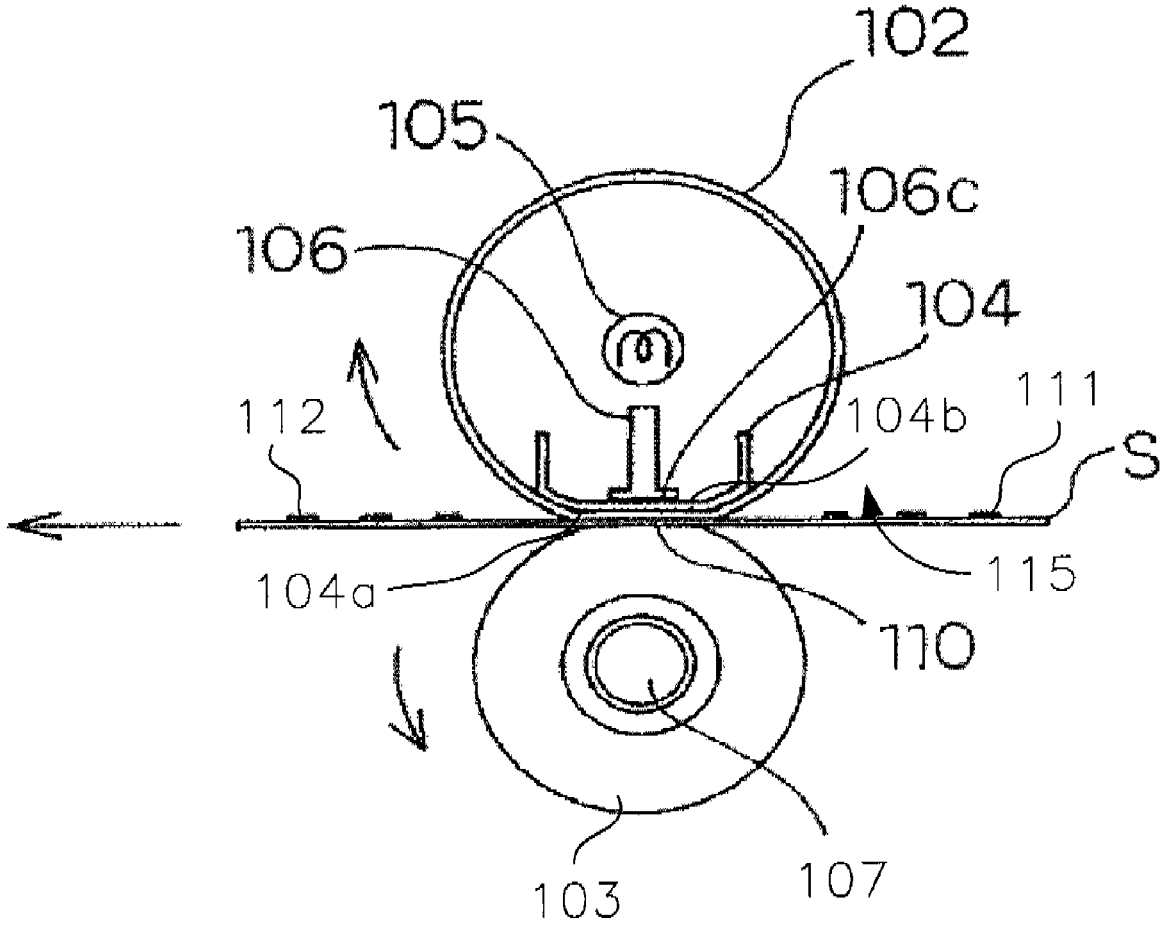
FIG. 2 is a schematic cross-sectional view showing the configuration of a fixing device of the image forming device.

A fixing device 100 according to the first embodiment of the present invention is provided near the drive roller 12. The fixing device 100 fixes unfixed images on recording sheets onto the recording sheets. As shown in FIG. 2, the fixing device 100 includes a fixing belt 102 which is a heating member, a pressure roller 103 which is a pressure member, a support member 104, a heat source 105, and a reinforcing member 106. The fixing belt 102 is preferably a flexible belt formed in an endless loop, and made from a material with appropriate stiffness and elasticity. As for the material of the fixing belt 102, for example, thin sheet metal (nickel, stainless steel, and so on) with a fluorine coating on the surface or the like may be used.

The fixing belt 102 is preferably a member with an endless metal sleeve as base that circulates in an approximately circular trajectory. A heater 105 is provided to the inside of the fixing belt 102 as radiant heat source. The heater 105 melts the toner on the recording sheet S to fix securely the toner onto the recording sheet S. A halogen lamp or the like, for example, is used as the heater 105.

Figure 3:
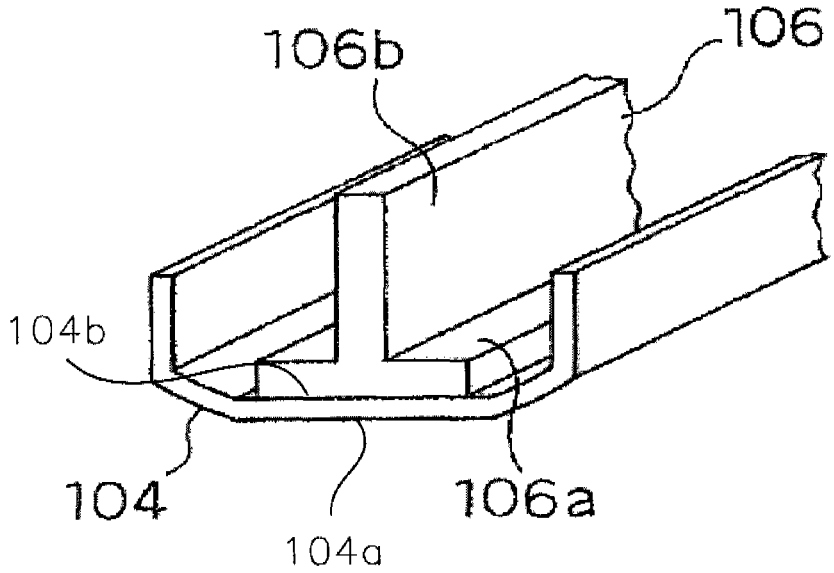
FIG. 3 is an isometric view of a support member and a reinforcing member of the fixing device.

As seen in FIGS. 2 and 3, the pressure roller 103 forms a nip point with a bottom surface 104*a* of the support member 104 that sandwiches and applies pressure to the fixing belt 102. The pressure roller 103 also makes the fixing belt 102 rotate in a predetermined direction.

The support member 104 is disposed to the inside of the ring shaped fixing belt 102. The length of the support member 104 is preferably formed to be the same as the width of the fixing belt 102 that is the heating member. The support member 104 is formed with an upwardly channel shaped concave as viewed cross-sectionally. Further, the bottom surface 104*a* (sliding surface) of the support member 104 slides against the inner surface of the fixing belt 102, and is the pressure surface that presses against the pressure roller 103. The support member 104 maintains the predetermined shape (a straight line shape in the example in the drawings) of the shape of the part where the flexible fixing belt 102 is in opposition to the pressure roller 103 to maintain the fixing nip. The support member 104 is made from a material of appropriate stiffness, for example a metal material such as stainless steel.

A reinforcing member 106 is provided on the rear side (upper surface) 104*b*, the top side in the figure, of the support member 104. The reinforcing member 106 provides rear, top, or opposing pressure so that the support member 104 can withstand the pressure of the pressure roller 103, and is made from a strong material such as stainless steel. As shown in FIGS. 2 and 3, the reinforcing member 106 is positioned to contact the surface 104*b* of the support member 104 opposite the bottom surface 104*a*. The reinforcing member 106 takes or bears the pressure force of the pressure roller 103 that is applied to the support member 104. The reinforcing member 106 includes a plate shaped member 106*a* in contact with the surface 104*b* of the support member 104 opposite the bottom surface 104*a*, and a rib shaped member (plate shaped rib) 106*b* that rises at right angles from the rear surface of the plate shaped member 106*a*. Also, the plate shaped member 106*a* and the rib shaped member 106*b* are disposed so that their cross-section forms an inverted T-shape. The reinforcing member 106 is installed on a machine frame (not shown in the drawings) by the rib shaped member 106*b*. By providing the reinforcing member 106, the support member 104 that contacts the fixing belt 102, which is the heating member, may be made smaller and still be capable of withstanding the pressure of the pressure roller 103. The reinforcing member 106 and the support member 104 may be separate members, as in the present embodiment, or they may be integral. Also, the thickness of the reinforcing member 106 is greater than the thickness of the support member 104.

Figure 4:
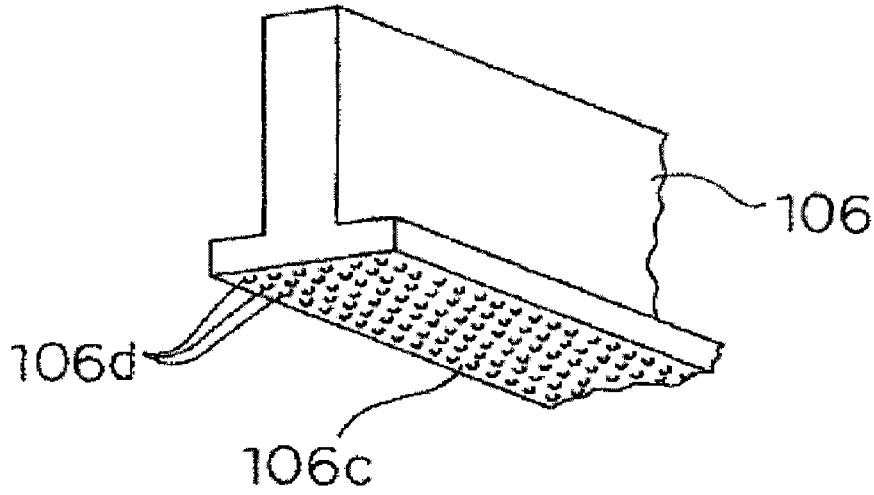
FIG. 4 is an alternate isometric view of the reinforcing member.
Figure 5:
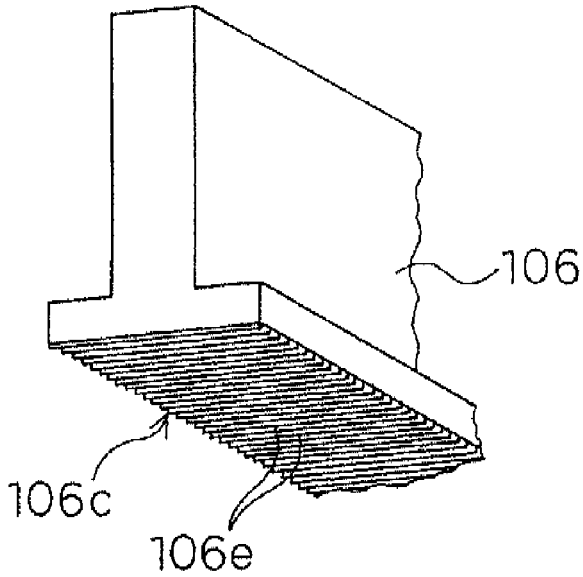
FIG. 5 is an isometric view of a modified reinforcing member.

The surface of the plate shaped member 106*a* of the reinforcing member 106 that is in contact with the support member 104 (the bottom surface in the drawings) preferably has an irregular surface (contact surface) 106*c*. FIG. 4 shows the case where the irregular surface includes a plurality of spherical projections 106*d*. Also, FIG. 5 shows a case in which the irregular surface 106*c* is provided with a plurality of rib-shaped projections 106*e* in the direction of rotation of the heating member that is the transfer belt 102 (in other words, the direction of transport of the recording sheets S).

In this way, the surface of the reinforcing member 106 in contact with the support member 104 is formed in an irregular shape. Therefore, the contact area between the reinforcing member 106 and the support member 104 is reduced so the amount of heat transmitted from the support member 104 to the reinforcing member 106 is reduced. As a result, the heat lost from the fixing belt 102, which is the heating member, is reduced. By forming the plurality of rib-shaped projections 106*e* shown in FIG. 5 in the direction of rotation of the fixing belt, in other words, along the direction of transport of the recording sheets S, it is possible to transport smoothly the recording sheets.

Figure 6:
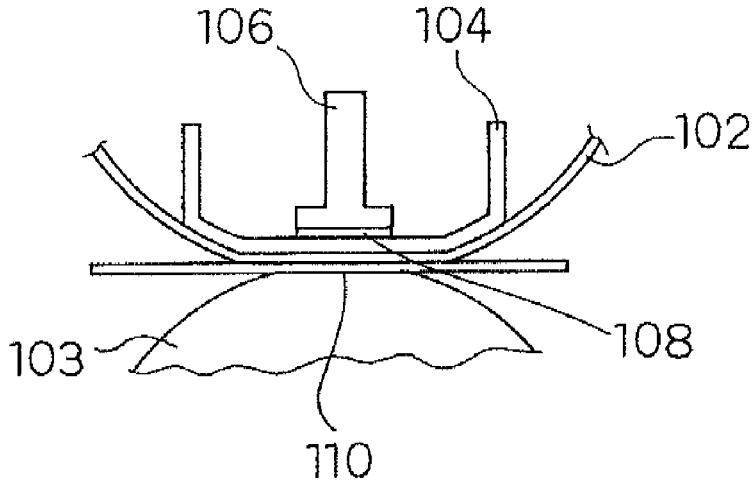
FIG. 6 is an enlarged view of a modified fixing device corresponding to FIG. 2.

FIG. 6 shows an embodiment that is different from the embodiment described above. In this embodiment, thermal insulation material 108 is placed between the support member 104 and the reinforcing member 106. The thermal insulation material 108 may be poly-etheretherketone (PEEK), polyimide (PI), polyamideimide (PAI), polybenzimidazole (PBI), polytetrafluoroethylene (PTFE), perfluoro alkoxyl alkane (PEA), a similar heat resistant resin or silicone rubber, or the like.

The thermal insulation material 108 is preferably formed in a plate shape, and is sandwiched between the support member 104 and the reinforcing member 106 and is fixed using an adhesive or similar fixing product. In this case, there is no necessity to form the surface of the reinforcing member 106 in an irregular shape, but the surface may be formed in an irregular shape.

As seen in FIG. 1, the pressure roller (pressure member) 103 is driven to rotate by a drive device that is not shown in the drawings, about a rotation shaft 107 in the direction of the arrow X at a predetermined speed. When the pressure roller 103 rotates, the fixing belt 102 in contact with the pressure roller 103 is driven to rotate together with the pressure roller 103 in the direction of the arrow Y. The gap between the fixing belt 102 and the pressure roller 103 forms a fixing nip 110 in which the recording sheets S are sandwiched.

The recording sheets S are the recording media onto which images are transferred. The recording sheets S are transported in the direction of the arrow Z from before the fixing nip 110 into the fixing nip 110. Transport guides 111 and 112 are provided before and after the fixing nip 110 to guide the movement of the recording sheets S. Also, a front detection device (photoelectric sensor or similar) 115 is provided before the fixing nip 110 to detect the front of recording sheets S.

Next, the operation of the image forming device 1 as shown in the drawings is explained. The image forming device 1 is driven so that the peripheral speed of the photosensitive drum 2 and the speed of movement of the transfer belt 3 are synchronized. Further, the main charger 4 uniformly charges the surface of the photosensitive drum 2. Also, the surface of the photosensitive drum 2 is scanned with laser light by the laser irradiation device 5 in an ON-OFF pattern corresponding to a specific image. An electrostatic latent image is formed on the surface of the photosensitive drum 2 corresponding to the image signal.

When the part on which the electrostatic latent image is formed reaches the position in opposition to the developing device 7 as a result of rotation of the photosensitive drum 2, toner is supplied to the entire surface. The supplied tones adheres electrostatically to the surface of the photosensitive drum 2 in the parts that are charged, but does not adhere to the parts that are not charged.

Further, a recording sheet S, which is the transfer medium, is supplied on the transfer belt 3 synchronized with the above operation. The recording sheet S is transported in synchronization with the rotation of the photosensitive drum 2, electrostatically adhering to the transfer belt 3 that has been charged by the belt charger 18 so that the toner image will be properly transferred onto the recording sheet S. The toner image is transferred onto a predetermined position on the recording sheet S at the transfer position T where the recording sheet S is sandwiched between the photosensitive drum 2 and the transfer belt 3. At the transfer position T, electrical charge of the reverse polarity is applied by the bias application transfer roller 15 so the toner image on the photosensitive drum 2 is transferred from the surface of the photosensitive drum 2 onto the surface of the recording sheet S.

The recording sheet S onto which the image has been transferred is transported as it is by the transfer belt 3 in the direction of the arrow symbol B. However, the transfer belt 3 is decharged by the decharger 19 before reaching the drive roller 12. As a result the recording sheet S ceases to adhere to the transfer belt 3, and separates from the transfer belt 3 at a separation position where the movement direction of the transfer belt 3 changes and turns downwards. The recording sheet S that has been separated from the transfer belt 3 is then transported to the fixing device 100.

The recording sheet S that has been transported to the fixing device 100 is transported on the inlet side transport guide 111, and brought into the fixing nip 110 where the recording sheet S is sandwiched between the fixing belt 102, which is the heating member, and the pressure roller 103, which is the pressure member, and pressure and heat are applied. In the fixing nip 110 pressure and heat are applied so that the toner strongly adheres to the recording sheet. Fixing is complete when the recording sheet S has passed through the fixing nip 110.

In the fixing device 100, the support member 104 that takes or bears the pressure of the pressure roller 103 and the reinforcing member 106 that supports the support member 104 from the rear are provided so it is possible to ensure a stable fixing pressure. Also, the reinforcing member 106 is provided so it is possible to make the support member 104 smaller, and to increase the area of the fixing belt 102 receiving radiant heat from the heater 105. Also, the heat capacity of the support member 104 is reduced by making the support member 104 smaller so it is possible to reduce the transfer of heat from the fixing belt 102 to the support member 104.

Furthermore, as seen in FIG. 6, the contact surface between the support member 104 and the reinforcing member 106 is formed in an irregular shape, or thermal insulation material is provided between the support member 104 and the reinforcing member 106. Therefore, it is possible to reduce the transfer of heat from the support member 104 to the reinforcing member 106. Therefore, it is possible to reduce the amount of heat that is lost from the fixing belt 102.

Example of Execution

Figure 7:
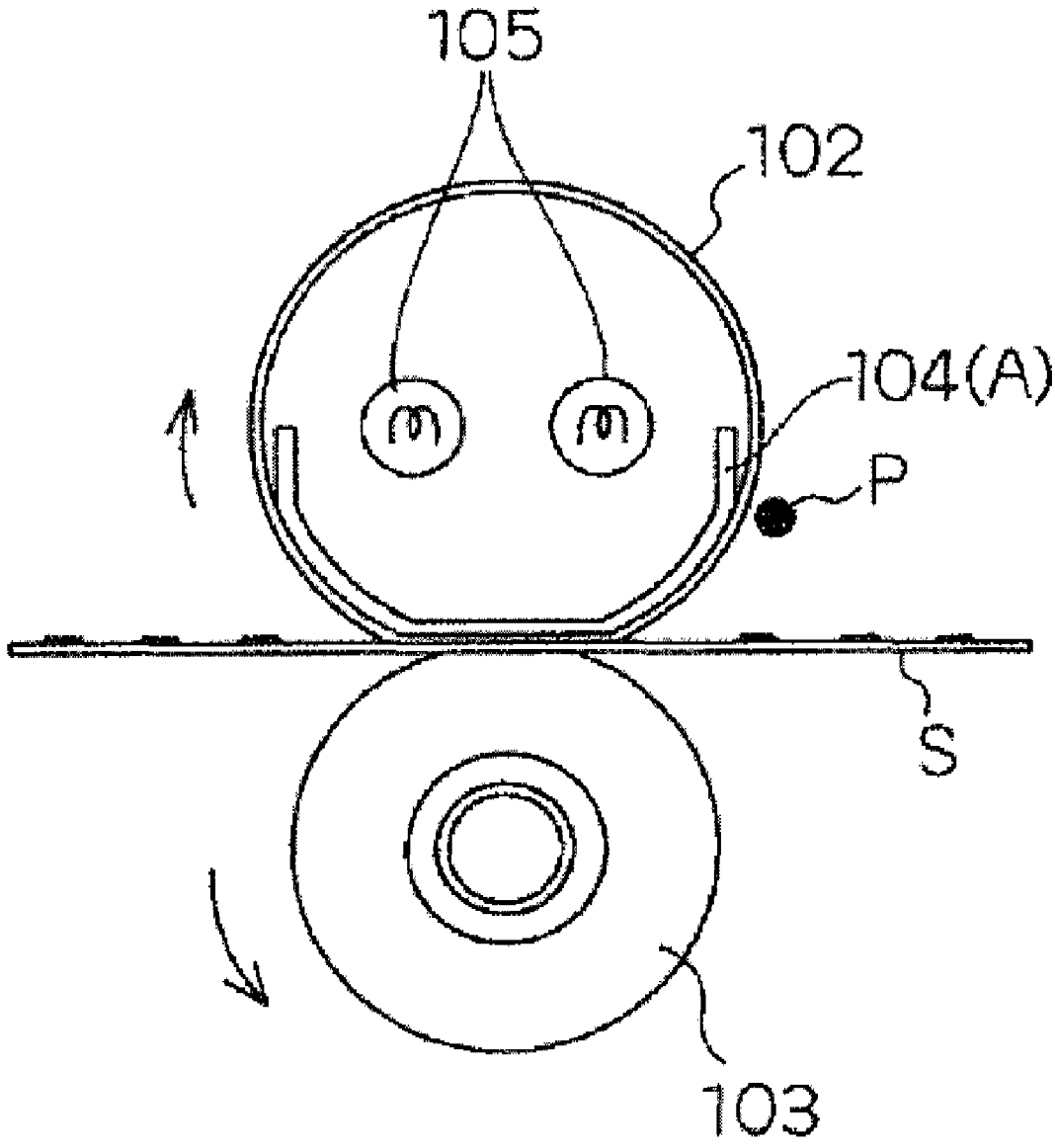
(Prior Art) Fig. 7
FIG. 7 is a schematic cross-sectional view of a conventional fixing device used for comparison.
Figure 8:
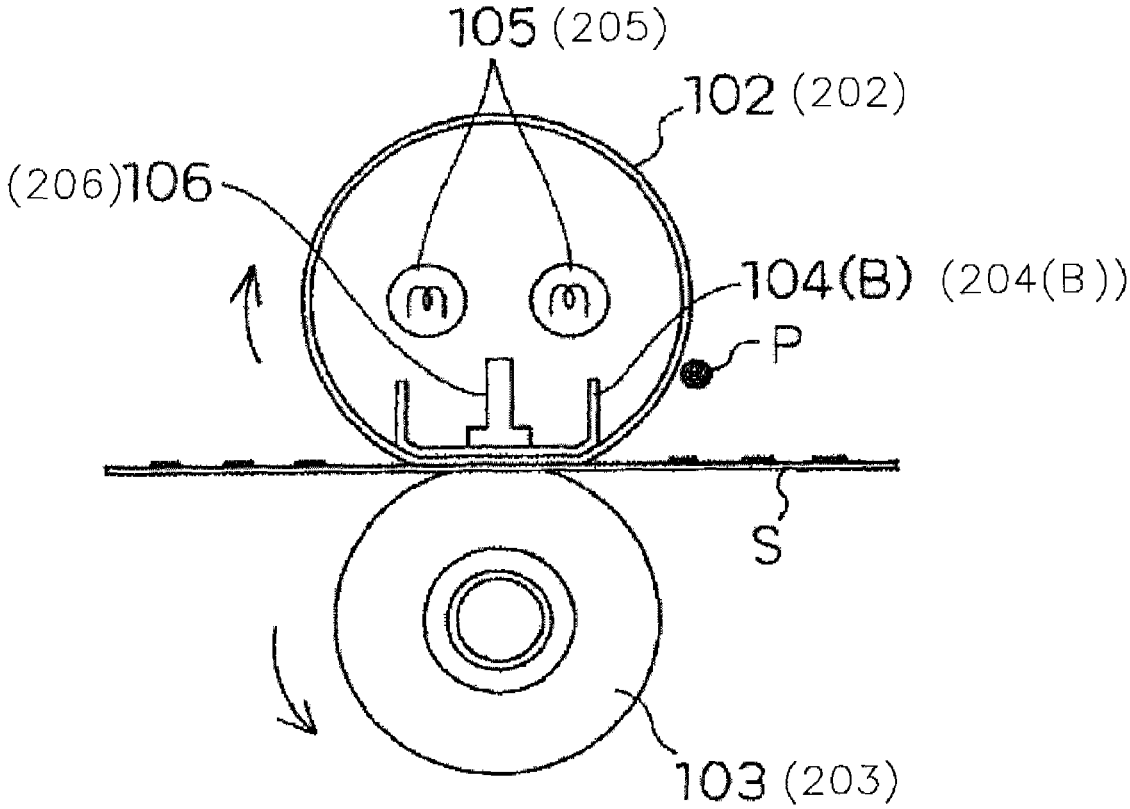
FIG. 8 is a schematic cross-sectional view of a fixing device used in accordance with the first embodiment for comparison.

In the fixing devices shown in FIG. 7 and FIG. 8, the effect of providing thermal insulation material in the fixing device 100 was examined. The fixing device shown in FIG. 7 represents a conventional device in which a support member 104 is provided but a reinforcing member 106 is not provided. The fixing device 100 shown in FIG. 8 represents an example of a device according to the present invention in which both a support member 104 and a reinforcing member 106 are provided.

Halogen heaters (500W+600W) were used as the heater (radiant heat source) 105. A stainless steel belt 0.03 mm thick, with a 30 mm diameter, and 310 mm long as a base on the surface of which a release layer made of a fluorine resin PFA was provided was used as the heating member (fixing belt) 102. Also, the support member 104 was made of SUS 304 stainless steel. The support member (A) shown in FIG. 7 had a thickness of 1 mm, and a thermal capacity of 55.2 J/K. The support member (B) shown in FIG. 8 had a thickness of 0.1 mm, and a thermal capacity of 5.02 J/K. Also, the reinforcing member was made from SUS 304 stainless steel, with a thickness of 1.0 mm and a thermal capacity of 30.1 J/K. Also, the material of the pressure roller 103 was silicone rubber, with a diameter of 25 mm, and a length 316 mm, with a surface release layer made of fluorine resin (PFA), and a metal core made of iron of diameter 12 mm.

For each of the devices shown in FIG. 7 and FIG. 8, the relationship between temperature and time was measured at the measurement point P under the following conditions. Condition 1 (comparison example) was with the conventional device as shown in FIG. 7. Condition 2 (comparison example) was with thermal insulation material between the support member 104(A) and the heating member 102. Condition 3 (comparison example) was with the device as shown in FIG. 8. Condition 4 (example of execution) was with thermal insulation material provided between the support member 104(B) and the reinforcing member 106 in the device of FIG. 8. TEFLON (PTFE) (registered trademark) tape of 0.1 mm thickness was used as the thermal insulation material. Also, a non-contacting type of sensor was used as the temperature sensor. The pressure roller 103 started to rotate at the same time that the heat source (heater) was turned on.

Figure 9:
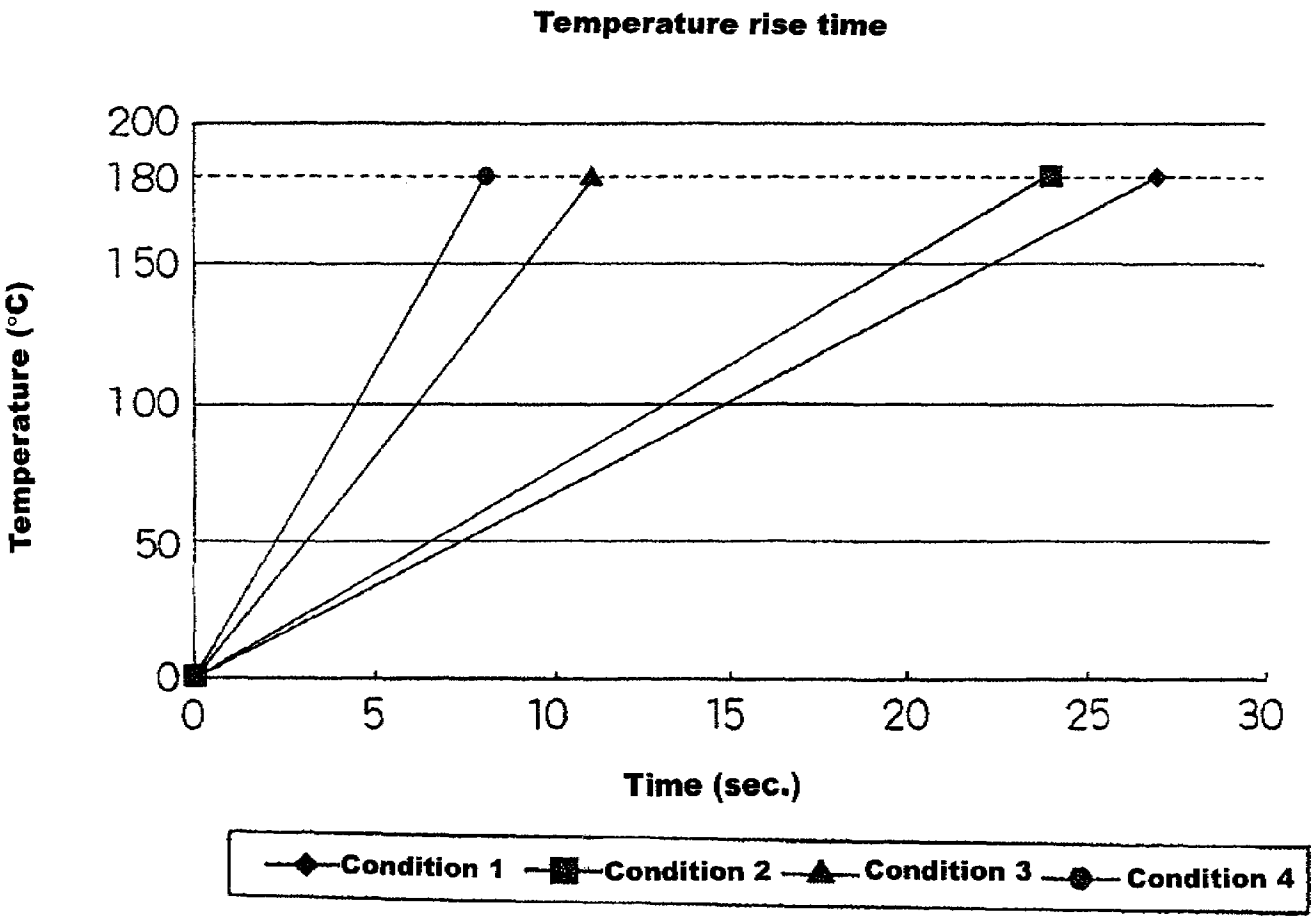
FIG. 9 is a view of a graph showing temperature measurement results.

The relationship between the measured temperature and time is shown in FIG. 9. The time required to reach a temperature of 180° C. at the measurement point P after turning the heater on was 27 seconds for Condition 1, 24 seconds for Condition 2, 11 seconds for Condition 3, and 8 seconds for Condition 4. From these results it can be seen that Condition 4 in which the reinforcing member 106 is provided and the support member 104 is made smaller has the shortest time to reach the predetermined temperature.

ALTERNATE EMBODIMENTS

Alternate embodiments will now be explained. In view of the similarity between the first and alternate embodiments, the parts of the alternate embodiments that are identical to the parts of the first embodiment will be given the same reference numerals as the parts of the first embodiment. Moreover, the descriptions of the parts of the alternate embodiments that are identical to the parts of the first embodiment may be omitted for the sake of brevity.

Second Embodiment

Apart from the fixing device, the configuration of the photocopier as image forming device 1 is substantially the same or the same as that of the first embodiment, so only the fixing device 200 is explained.

Figure 10:
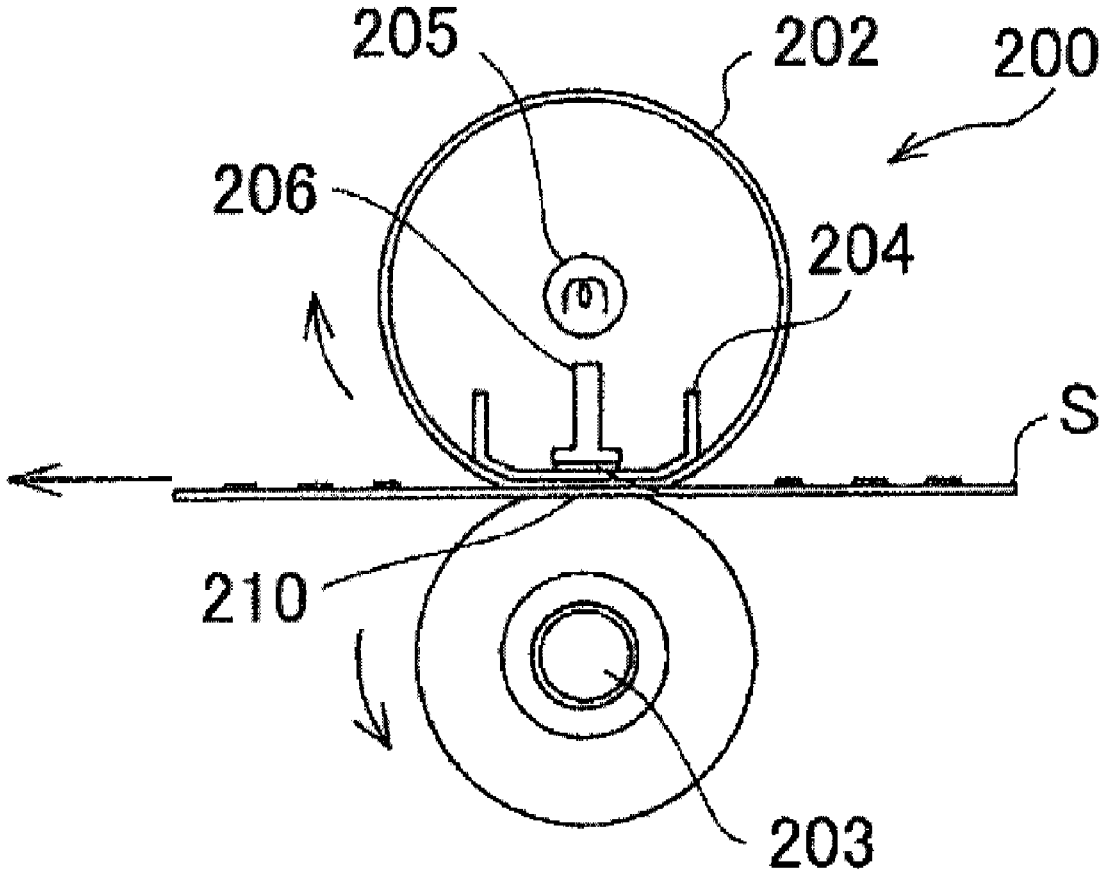
FIG. 10 is a schematic cross-sectional view showing the configuration of a fixing device according to a second preferred embodiment of the present invention.

As shown in FIG. 10 and in accordance with a second preferred embodiment, the fixing device 200 includes a fixing belt 202, which is the heating member, a pressure roller 203, which is the pressure member, a support member 204, a heat source (heater) 205, and a reinforcing member 206. The configuration of the pressure roller 203 and the heat source 205 are substantially the same or the same as in the first embodiment, so their explanation is omitted.

The fixing belt 202 is a flexible belt formed into an endless shape, having appropriate stiffness and elasticity. The material can be for example a thin sheet metal (nickel, stainless steel, or the like) on the surface of which a fluorine coating or the like is applied.

At least one of the support member 204 and the reinforcing member 206 is made from a thermal insulation material. The thermal insulation material may be polyetheretherketone (PEEK), polyimide (PI), polyamideimide (PAI), polybenzimidazole (PBI), polytetrafluoroethylene (PTFE), perfluoro alkoxyl alkane (PFA), or a similar heat resistant resin.

In the example in the figure at least one of the support member 204 and the reinforcing member 206 is formed completely of a thermal insulation material. However, depending on the circumstances just a part may be made from thermal insulation material. In this case, it is desirable to form a part that includes a surface that is in contact with another member from thermal insulation material. For example, if forming a part of the support member 204 from thermal insulation material, a part that contacts the fixing belt 202, which is the heating member, or a part that contacts the reinforcing member 206 should be formed from thermal insulation material. Alternatively, in the case of the reinforcing member 206, the part in contact with the support member 204 should be formed of thermal insulation material.

In the fixing device 200, the support member 204 that takes or bears the pressure of the pressure roller 203 and the reinforcing member 206 that supports the support member 204 are provided so that it is possible to ensure a stable fixing pressure. Also, the reinforcing member 206 is provided so that it is possible to make the support member 204 smaller, and increase the area of the fixing belt 202 receiving radiant heat from the heater 205. Also, it is possible to reduce the transfer of heat from the fixing belt 202 to the support member 204.

Further, a part or all of the support member 204 and/or the reinforcing member 206 is made from a thermal insulation material. Therefore, it is possible to reduce the quantity of heat transferred from the fixing belt 202 to the support member 204 and the reinforcing member 206.

Example of execution

Halogen heaters (500 W+600 W) were used as the heater (radiant heat source) 205. The thickness and diameter of the heating member (fixing belt) 202 were respectively 0.03 mm and 30 mm. A 310 mm long stainless steel belt as a base provided with a releasing layer made from a fluorine resin PFA was used. Also, the material of the support member was SUS 304 stainless steel. In the comparison example of FIG. 7 the support member (A) had a thickness of 1 mm, and a thermal capacity of 55.2 J/K. In the comparison example of FIG. 8 the support member 104(B) had a thickness of 0.1 mm, and a thermal capacity of 5.02 J/K. The material of the reinforcing member 206 was SUS 304 stainless steel, with a thickness of 1.0 mm and a thermal capacity of 30.1 J/K. Also, the material of the pressure roller 103 was silicone rubber, with diameter 25 mm, length 316 mm, with a surface release layer made of fluorine resin (PFA), and a metal core made of iron of diameter 12 mm.

For each of the devices shown in FIG. 7 and FIG. 8, the relationship between temperature and time was measured at the measurement point P under the following conditions. Condition 1 (comparison example) was with the conventional device as shown in FIG. 7. Condition 2 (comparison example) was with the device as shown in FIG. 8. Condition 3 (example of execution) was with the reinforcing member 206 provided with a layer of thermal insulating material (thickness 0.1 mm Teflon (PTFE) (registered trademark) tape in the part in contact with the support member 204(B) in the device of FIG. 8. Condition 4 (example of execution) was with the support member 204(B) in the device of FIG. 8 made from thermal insulating material (PEEK). Condition 5 (example of execution) was with the reinforcing member 206 made from thermal insulating material (PEEK). Also, a non-contacting type of sensor was used as the temperature sensor. The pressure roller 203 started to rotate at the same time that the heat source (heater) was turned on.

Figure 11:
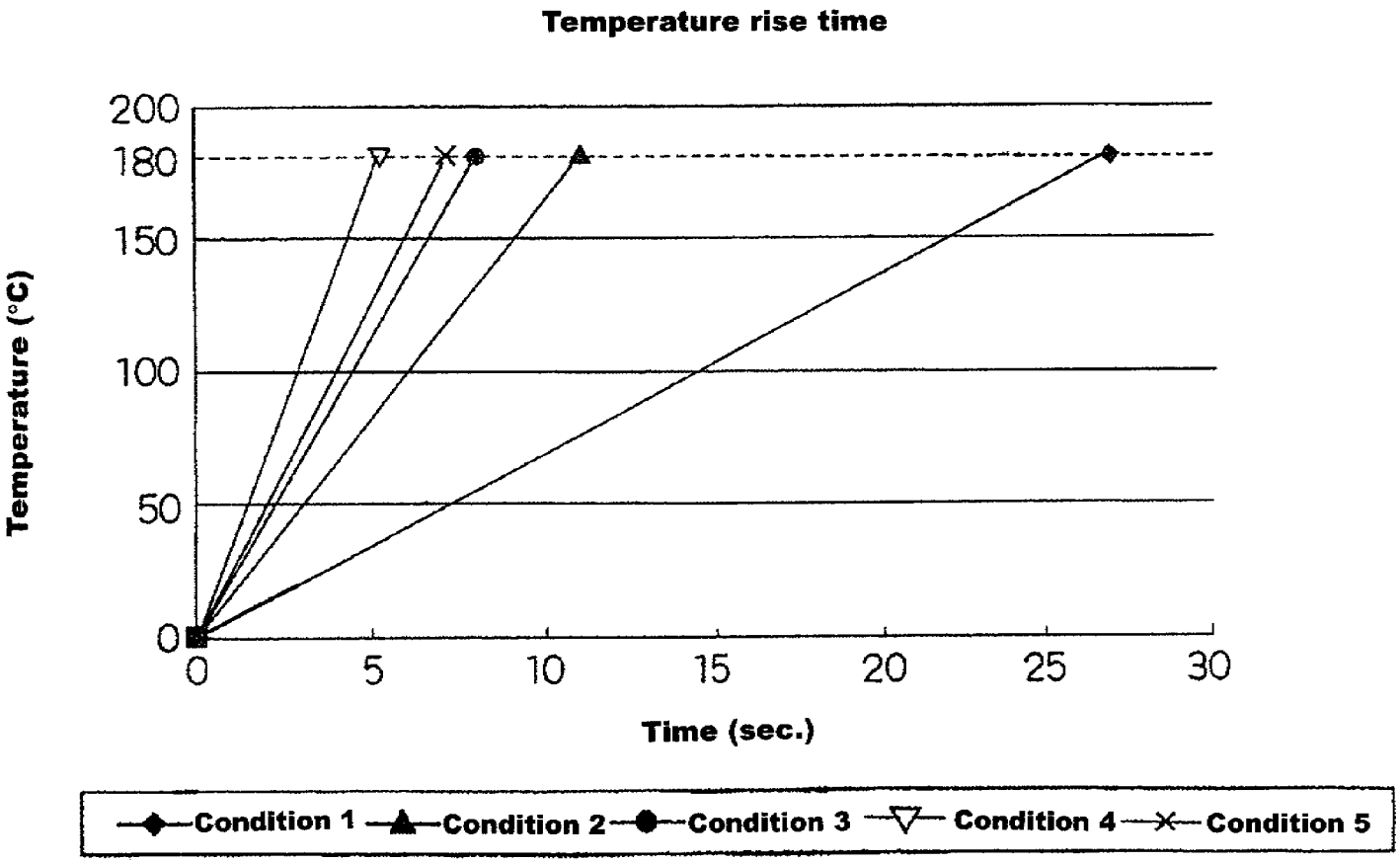
FIG. 11 is a view of a graph showing temperature measurement results.

The relationship between the measured temperature and time is shown in FIG. 11 .The time required to reach a temperature of 180° C. after turning the heater on at the measurement point P was 27 seconds for Condition 1, 11 seconds for Condition 2, 8 seconds for Condition 3, 6 seconds for Condition 4, and 7.5 seconds for Condition 5. From the results it can be seen that by providing a reinforcing member 106 and making a part of it from thermal insulating material (Condition 3), making the support member 104(B) of a thermal insulating material (PEEK) (Condition 4), and making the reinforcing member from a thermal insulating material (PEEK) (Condition 5) it is possible to raise the temperature to a predetermined temperature in a short time.

Third Embodiment

The following is an explanation of a fixing device according to a third embodiment of the present invention based on the drawings. However, the present invention is not limited to these embodiments.

Figure 12:
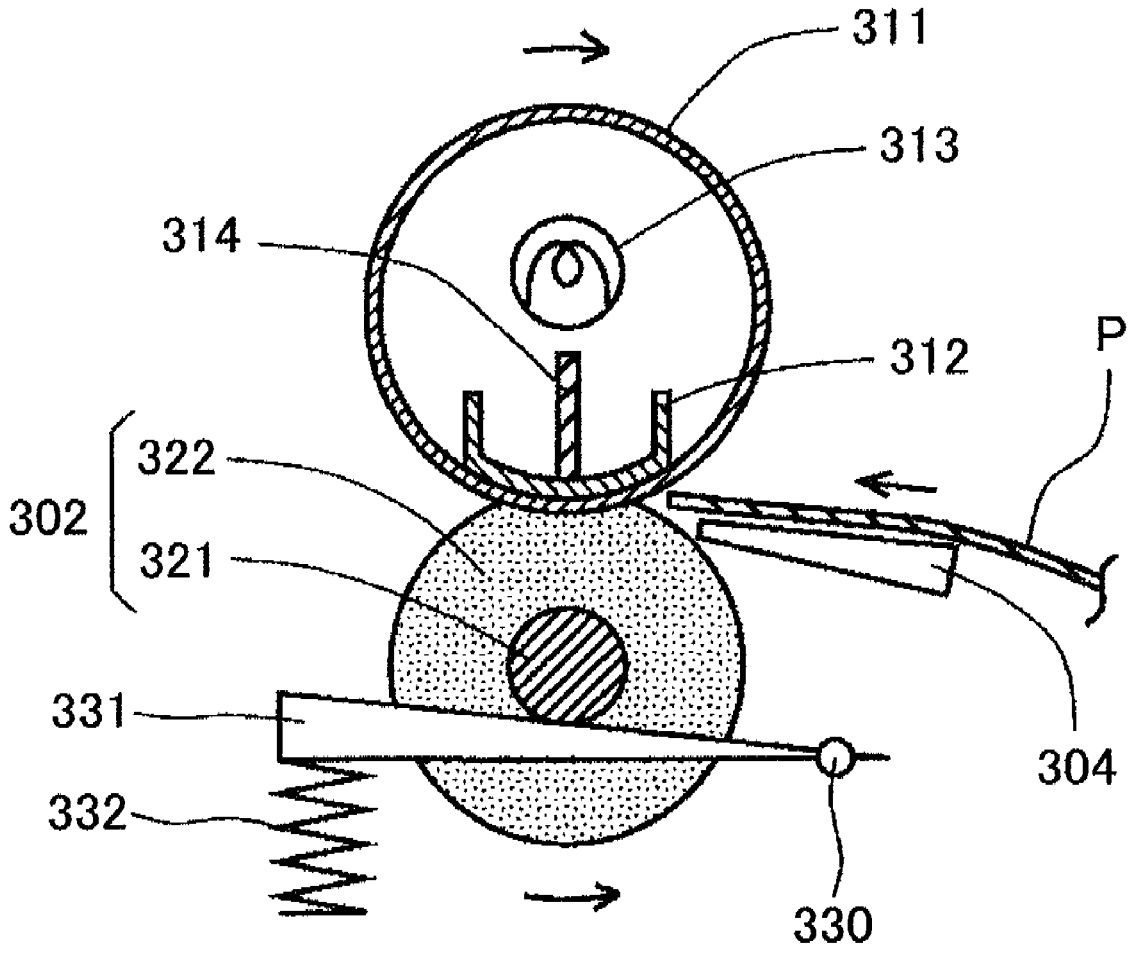
FIG. 12 is a view of an outline diagram showing an example of a fixing device according to a third preferred embodiment of the present invention.

FIG. 12 is an outline diagram showing an embodiment of a fixing device according to a third aspect of the present invention. The fixing device in FIG. 12 includes a cylindrical shaped film 31 1, a linear halogen lamp (heat source) 313, a support member 312, a plate shaped reinforcing member 314, and a pressure roller (pressure member) 302. The cylindrical shaped film 311 can freely rotate. The linear halogen lamp 313 is inserted into the approximate center of the film 31 1. The support member 312 has an approximately U-shaped cross-section that is in sliding contact with the inner periphery of the film 311. The plate shaped reinforcing member 314 is installed approximately normal or normal to and in the center of in the lengthwise direction of the inner surface of the support member 312. The pressure roller 302 presses against the support member 312 via the film 311.

The pressure roller 302 is a member formed from a metal core 321 on the outer periphery of which an elastic layer 322 made from Si rubber or the like is formed. When necessary, a releasing layer (not shown on the drawings) made from fluorine resin or the like is formed on the outer periphery of the elastic layer 322. The metal core 321 is pressed towards the support member 312 by a support member 331 that is rotatably supported at one end by a shaft 330 and that is pressed in the clockwise direction by a spring 332 at the other end. In this way, the pressure roller 302 is pressed towards the support member 312 via the film 311 to form a nip.

The pressure roller 302 is rotated in the counterclockwise direction by a motor that is not shown in the drawings, and in this way the film 311 that is under pressure contact in the nip is driven in the clockwise direction. A sheet P is guided by a guide 304 to the nip, is held and transported in the nip, and at the same time the toner image on the sheet P is melted and fixed by the heat and pressure.

Figure 13:
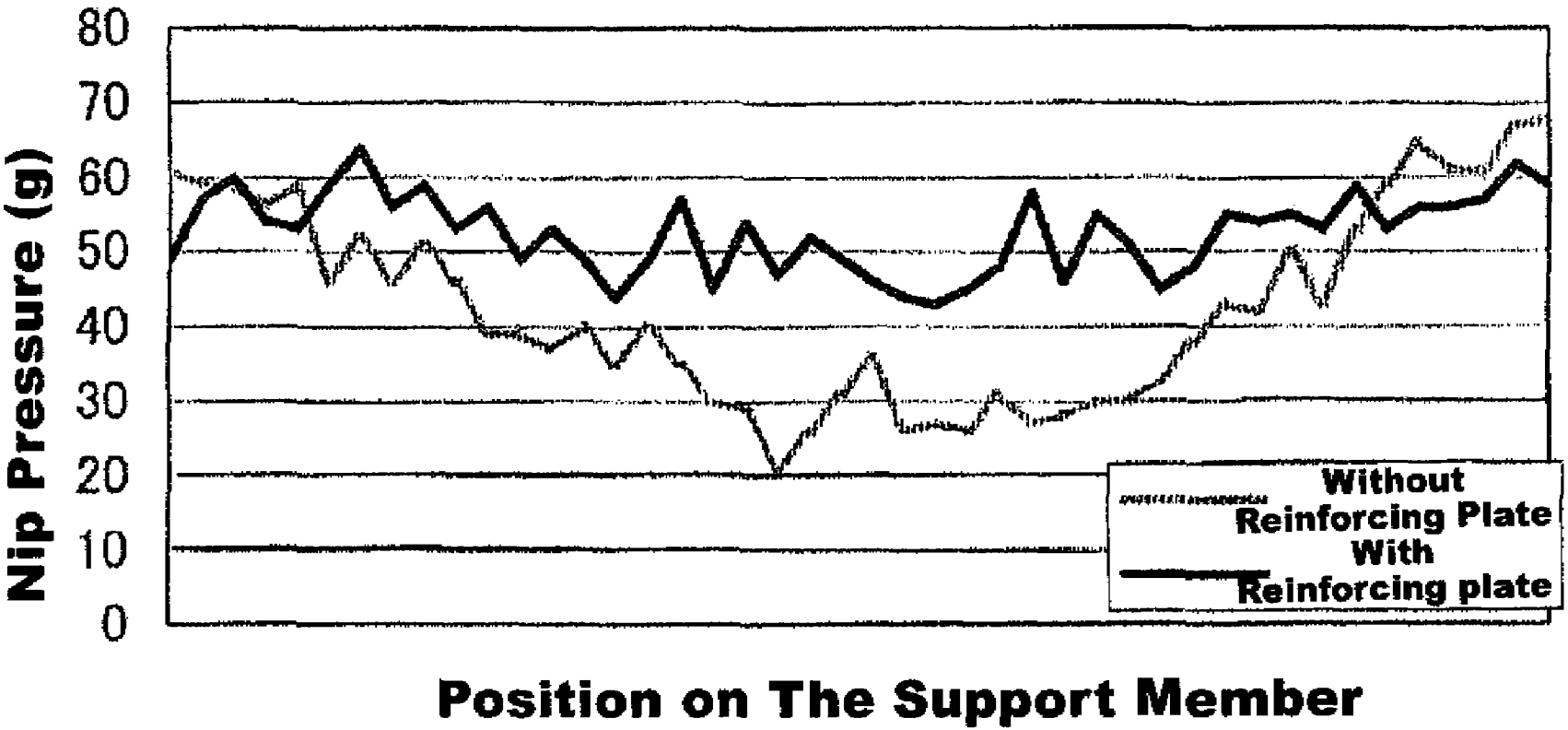
FIG. 13 is a view of a diagram showing the variation in nip pressure in a lengthwise direction according to whether there is a reinforcing member or not.

The support member 312 has a U-shaped cross-section, whose bottom surface (sliding contact surface) 3 12*a* (shown in FIG. 14) is in sliding contact with the inner peripheral surface of the film 311, and forms the nip with the pressure roller 302. Here, the plate shaped reinforcing member 314 is installed in a lengthwise direction in approximately the center of the area on the side of the support member 31 2 that takes the pressure force from the pressure roller 302. The plate thickness of the reinforcing member 314 is thicker than that of the support member 312. Deformation of the support member 312 due to the pressure force of the pressure roller 302 is effectively prevented by the reinforcing member 314. For example, if the thickness of the support member 312 is reduced from the 2 mm that has been used to date to about 0.1 mm, deformation of the support member 312 can be sufficiently prevented by installing the reinforcing member 314 with a thickness of about 2 mm. FIG. 13 shows the results of tests carried out by the inventors.

FIG. 13 shows the nip pressure on the vertical axis relative to the position in the lengthwise direction along the support member 312 on the horizontal axis, and plots the nip pressure at each position in the length direction of the support member 312. In the case where the reinforcing member 314 is installed on the support member 312, the nip pressure in the lengthwise direction of the support member 312 is maintained within the range 50±10 g. In contrast to this, in the case where the reinforcing member 314 is not installed on the support member 312, the nip pressure on the support member 312 was about 60 g at both ends in the length direction, and about 20 g in the center. The nip pressure was reduced in the center in the length direction. This is caused by the support member 312 becoming curved due to the pressure force of the pressure roller 302, so the nip pressure in the center is reduced.

The reinforcing member 314 may be integrally formed with the support member 312, or may be installed as a separate member after manufacture. The latter is preferable from the view point of manufacturing ease. If the reinforcing member 314 is manufactured as a separate member and installed on the support member 312, then welding, adhesive bonding, or another conventional publicly known method may be used as the installation method. However, if the reinforcing member 314 and the support member 312 are joined along the entire contact surface, the heat transfer from the support member 312 to the reinforcing member 314 increases, although the joint strength is increased. This is not desirable from the view point of improving the thermal efficiency and reducing the energy consumption of the fixing device.

Figure 14A:
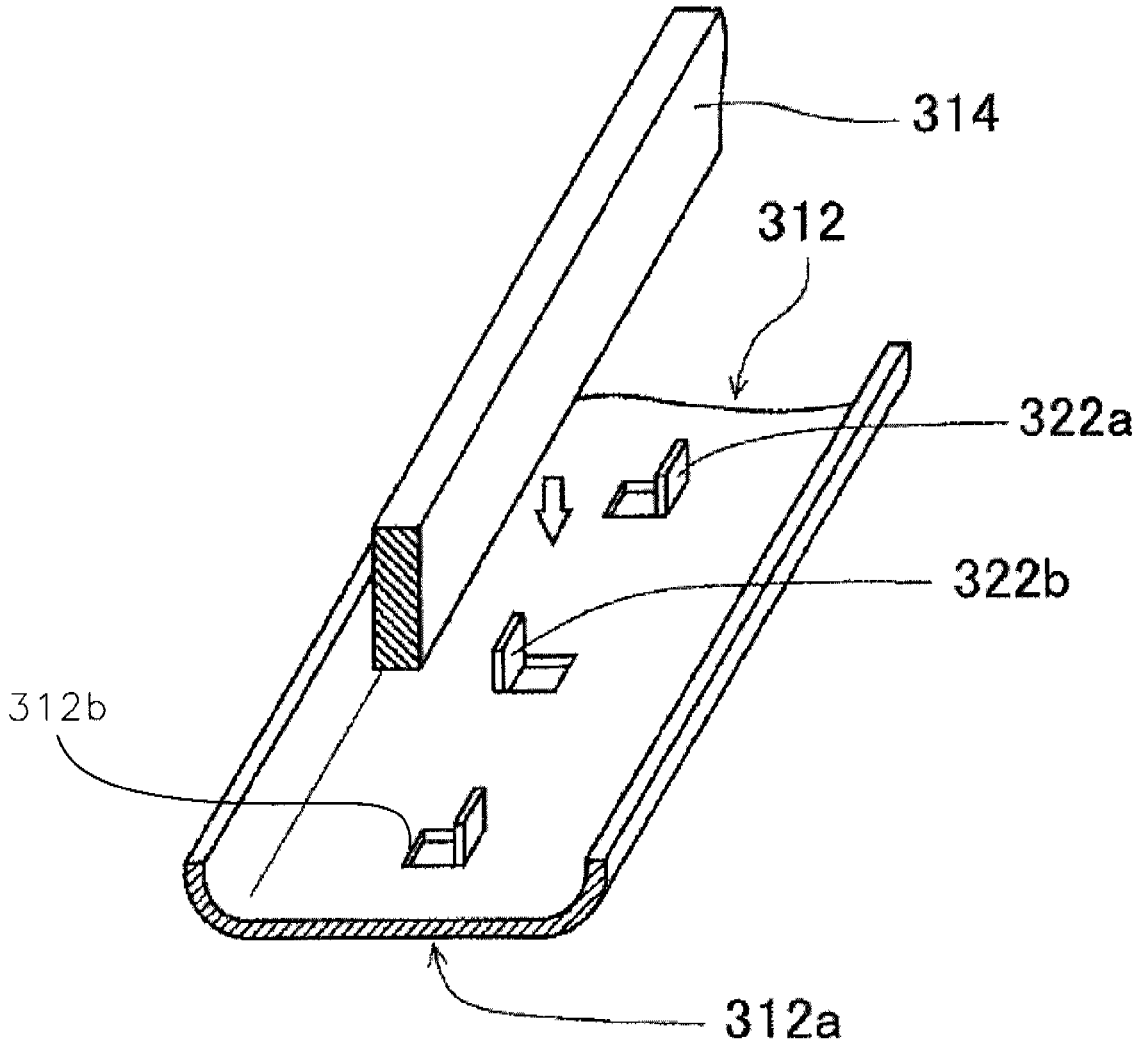
FIGS. 14A and 14B are isometric views showing an example of installation of the reinforcing member on the support member.
Figure 14B:
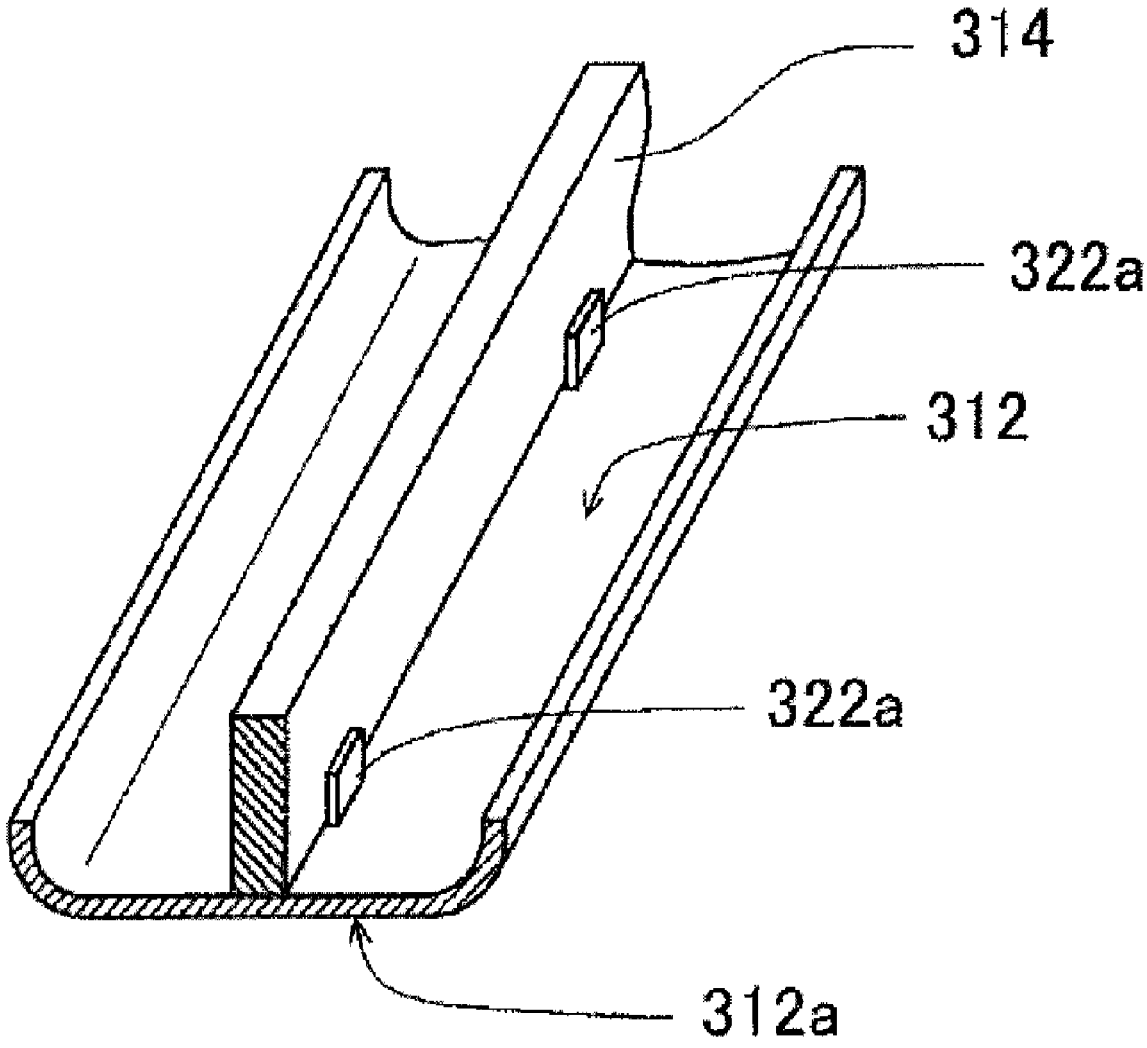

Therefore, it is desirable that the connection area between the support member 312 and the reinforcing member 314 be reduced provided the strength of the support member 312 is not greatly reduced. For example, as shown in FIGS. 14A and 14B, after forming cuts in the shape of three sides of a rectangle in the sliding contact surface 312*a* of the support member 312 to form apertures or cutout parts 312*b*, support portions 322*a* and 322*b* that are raised upwards are formed on alternate sides of the resulting cutout parts 312*b* in the lengthwise direction, preferably one support portion 322*a* or 322*b* per cutout part 312*b*. Then the reinforcing member 314 may be fitted between the support portions 322*a* and 322*b*. In this way, the support member 312 and the reinforcing member 314 are securely connected, and a small air layer is formed in the connection of the two members. Therefore heat transfer from the support member 312 to the reinforcing member 314 is reduced. As a result, the heat capacity is increased by only a small amount due to installing the reinforcing member 314 on the support member 312.

Figure 15:
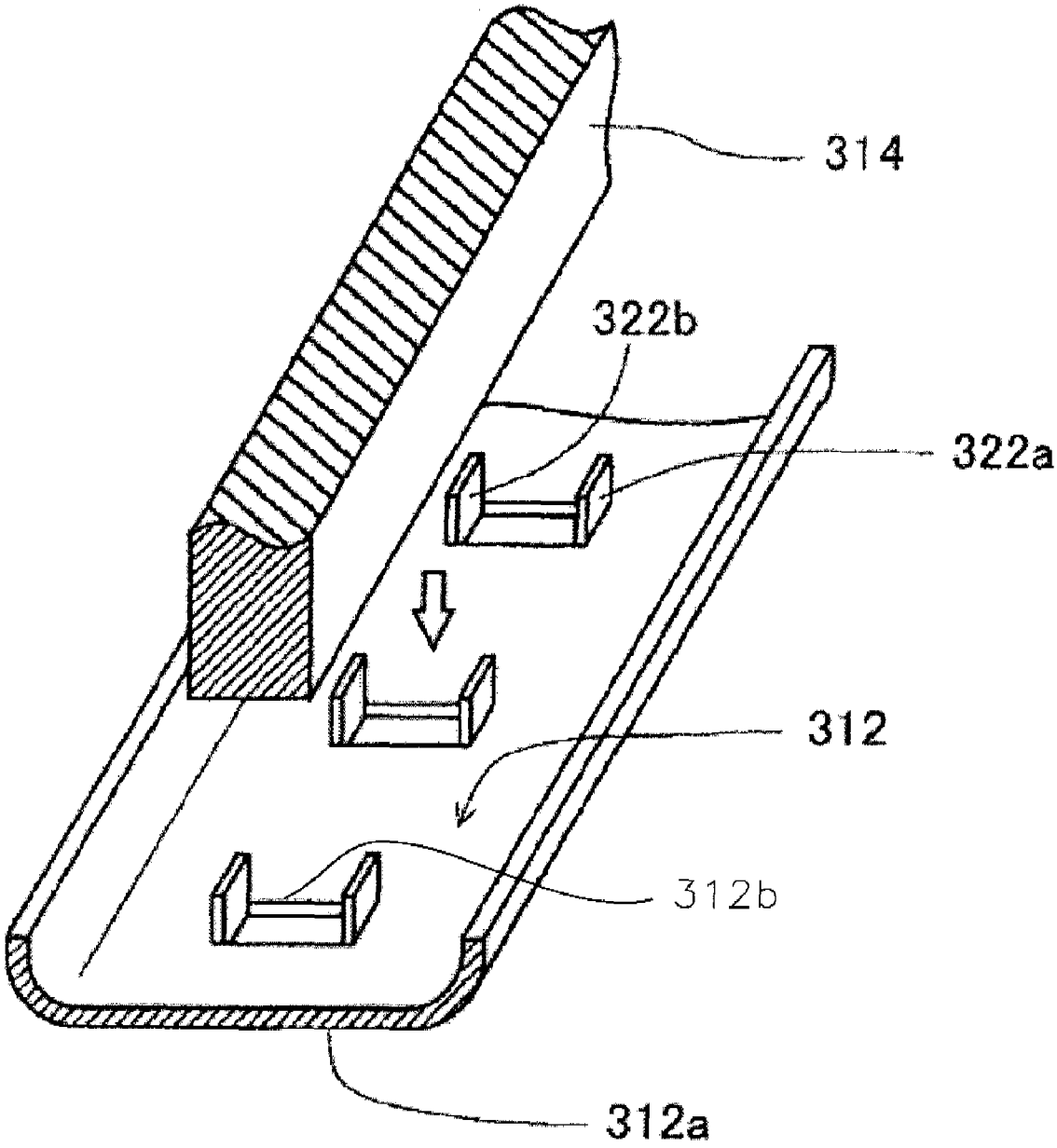
FIG. 15 is an isometric view showing another example of installation of the reinforcing member on the support member.

FIG. 15 shows another example in which support portions 322*a* and 322*b* are cut in the sliding contact surface 3 12*a* of the support member 312. In the support member 312 in this figure, linear-shaped cuts are formed in the shape of an "H" to form the cutout parts 312*b*, and tabs are bent upwards to form the support portions 322*a* and 322*b* on opposite sides of each resulting cutout part 312*b*. The spacing of the support members 322*a* and 322*b* is approximately the same as the thickness of the reinforcing member 314. By fitting the reinforcing member 314 between the support portions 322*a* and 322*b* the reinforcing member 314 is installed on the support member 312. With this method of installation, the support member 312 and the reinforcing member 314 are securely connected, as stated previously, and heat transfer from the support member 312 to the reinforcing member 314 can be reduced. Therefore, the increase in the thermal capacity due to installing the reinforcing member 314 on the support member 312 can be reduced.

Of course, in order to increase the installation strength in the embodiment described above, a connection product such as bonding using an adhesive or welding may also be used.

There is no particular limitation on the thickness or length of the reinforcing member 314, these may be determined as appropriate from the pressure force of the pressure roller 302. Based on considerations of reducing the thermal capacity of the reinforcing member 314, the reinforcing member 314 should be made as thin and as short as possible. Also, a plurality of holes may be provided in the reinforcing member 314 to further reduce the thermal capacity of the reinforcing member 314. Examples of the material of the reinforcing member 314 include stainless steel or iron, aluminum, copper, magnesium, and so on.

Also, it is desirable to make the surfaces of the reinforcing member 314 that receive radiant light from the halogen lamp 313 white or metal color, or similar, to reflect the radiant light. This is because rather than heating the reinforcing member 314 with the radiant light, the film 31 1 is heated by the radiant light reflected from the reinforcing member 314. Therefore the thermal efficiency can be increased and the warming up time can be reduced.

Examples of the material of the support member 312 used in the present invention include stainless steel or iron, aluminum, copper, magnesium, and so on, similar to the reinforcing member 314. Holes may be formed in the support member 312 to reduce the thermal capacity and increase the thermal efficiency. In this case, the holes may be formed by press forming. Also, the support member 312 is in sliding contact with the inner peripheral surface of the film so it is recommended that a lubricating material such as silicone grease or the like be applied to the sliding contact surface 312*a* of the support member 312. By applying a lubricating material, the rotational torque of the film 311 is reduced, and wear can be limited.

Also, it is desirable to make the inner surface of the support member 312 that receives radiant light from the halogen lamp 313 white or metal color, or similar, to reflect the radiant light.

This is because rather than indirectly heating the film 31 1 via the support member 312 by heating the support member 312 by the radiant light, and heating the film 311 by the heated support member 312, directly heating the film 31 1 by the radiant light reflected from the support member 312 has greater thermal efficiency and the speed of heating is higher.

Figure 16:
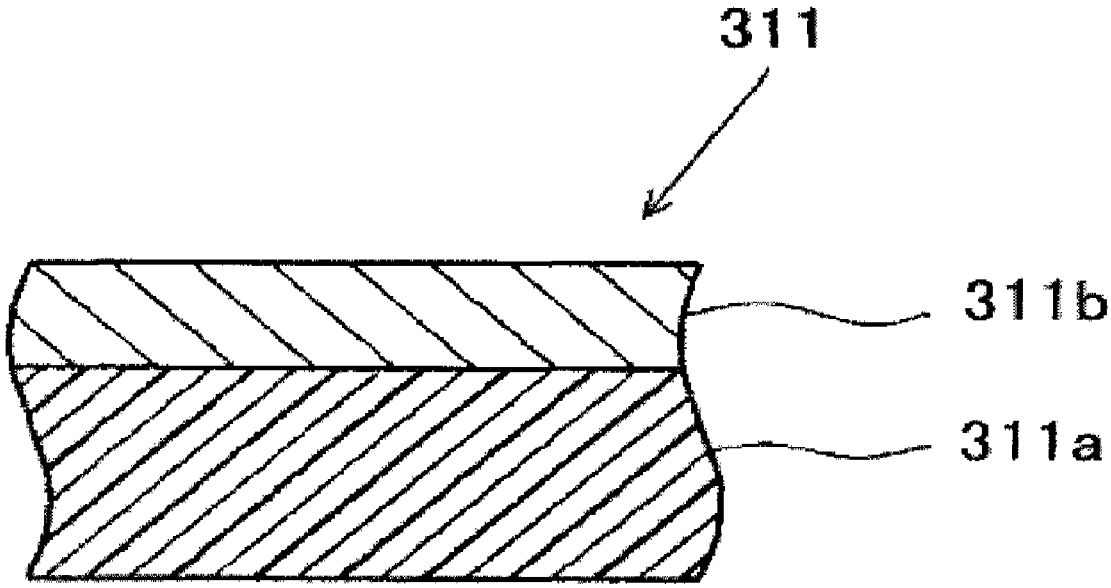
FIG. 16 is a cross-sectional view showing an example of the film used in the present invention.

The film 311 used in the present invention may be a two layer structure including a base layer 311*a* and a releasing layer 311*b*, as shown in FIG. 16. In this film 31 1, the base layer side is in sliding contact with the support member 312, and the releasing layer is in contact with the sheets P. It is desirable that the material of the base layer has excellent heat resistance and sliding contact properties. For example, the material can be a heat resistant resin such as polyimide or polyamideimide, or a metal material such as stainless steel, nickel, aluminum, or copper. On the other hand, the material of the releasing layer 311*b* may be a fluorine resin such as PTFE or PFA. Also, an infrared absorbent material is mixed into and dispersed in the releasing layer 311*b*. In this way, it is possible to efficiently absorb radiant light (infrared light). The infrared absorbent material may be carbon black, graphite, iron oxide, or a similar material. By mixing and dispersing carbon black the surface resistance of the film 311 is reduced, friction charge in the film 31 1 is reduced, and adherence of the toner on the sheets onto the film 311 can be prevented. Of course, if necessary an elastic material may be provided between the base layer 311*a* and the releasing layer 311*b*.

INDUSTRIAL APPLICABILITY

The fixing device according to the present invention can be effectively used as the fixing device in an image forming device such as a photocopier, printer, or facsimile that uses electrophotographic technology.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including," "having," and their derivatives. Also, the terms "part," "section," "portion," "member," or "element" when used in the singular can have the dual meaning of a single part or a plurality of parts. As used herein to describe the present invention, the following directional terms "forward, rearward, above, downward, vertical, horizontal, below and transverse" as well as any other similar directional terms refer to those directions of an image forming device equipped with the present invention. Accordingly, these terms, as utilized to describe the present invention should be interpreted relative to an image forming device. Finally, terms of degree such as "substantially," "about," and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A fixing device, comprising:

an endless loop shaped heating member;

a heating source being disposed within said heating member;

a support member having a contact surface contacting an inside surface of said heating member;

a pressure member contacting a part of said heating member corresponding to a part contacting said contact surface of said support member; and a reinforcing member reinforcing said support member, a plurality of spherical-shaped projections being formed on said contact surface of said reinforcing member.

2. The fixing device according to claim 1, wherein the thickness of said reinforcing member is thicker than the thickness of said support member.

3. The fixing device according to claim 1, wherein a base material of said heating member is a metal sleeve, said pressure member forms a nip with said contact surface of said support member between which said heating member is sandwiched and pressed and said pressure member drives said heating member to rotate in a predetermined direction, said reinforcing member has a contact surface, which contacts said support member, on which a plurality of irregularities is formed, that receives a pressure force of said pressure member applied to said support member in a position on a side opposite to said contact surface of said support member.

4. The fixing device according to claim 1, wherein said heating member is a cylindrical shaped film that can freely rotate, said heat source is provided within said film and radiates radiant heat, said support member has a contact surface that contacts an inner peripheral surface of said film, said pressure member presses against said contact surface of said support member via said film, and said reinforcing member is a plate shaped member that is installed on a surface of said support member opposite said contact surface in the length direction and substantially perpendicular to said support member.

5. The fixing device according to claim 1, wherein said reinforcing member has a plate shaped member that contacts a surface of said support member opposite to said contact surface of said support member, and a plate shaped rib disposed on a upper surface of said plate shaped member opposite to said support member in approximately the center of said plate shaped member in the width direction and at right angles to said plate shaped member.

6. The fixing device according to claim 1, wherein at least one of said support member and said reinforcing member is formed either in whole or in part from a thermal insulation material.

7. A fixing device, comprising:

an endless loop shaped heating member;

a heating source being disposed within said heating member;

a support member having a contact surface contacting an inside surface of said heating member;

a pressure member contacting a part of said heating member corresponding to a part contacting said contact surface of said support member;

a reinforcing member reinforcing said support member; and a plurality of rib-shaped projections extending in the rotation direction of said heating member being formed on said contact surface of said reinforcing member.

8. The fixing device according to claim 7, wherein said reinforcing member has a plate shaped member that contacts a surface of said support member opposite to said contact surface of said support member, and a plate shaped rib disposed on a upper surface of said plate shaped member opposite to said support member in approximately the center of said plate shaped member in the width direction and at right angles to said plate shaped member.

9. The fixing device according to claim 7, wherein the thickness of said reinforcing member is thicker than the thickness of said support member.

10. The fixing device according to claim 7, wherein at least one of said support member and said reinforcing member is formed either in whole or in part from a thermal insulation material.

11. A fixing device, comprising:

an endless loop shaped heating member;

a heating source being disposed within said heating member;

a support member having a contact surface contacting an inside surface of said heating member;

a pressure member contacting a part of said heating member corresponding to a part contacting said contact surface of said support member, and a reinforcing member reinforcing said support member, said reinforcing member having a plate shaped member contacting a surface of said support member opposite to said contact surface of said support member, and a plate shaped rib being disposed on an upper surface of said plate shaped member opposite to said support member in approximately the center of said plate shaped member in the width direction and at right angles to said plate shaped member.

12. The fixing device according to claim 11, further comprising thermal insulation material arranged between said support member and said reinforcing member.

13. The fixing device according to claim 12, wherein said thermal insulation material is a heat resistant resin or silicone rubber

14. The fixing device according to claim 11, wherein a base material of said heating member is a metal sleeve, said pressure member forms a nip with said contact surface of said support member between which said heating member is sandwiched and pressed, and said pressure member drives said heating member to rotate in a predetermined direction, said reinforcing member contacts the support member on a side opposite to said support member to said heating member and receives a pressure force from said pressure member applied to said support member, and at least one of said support member and said reinforcing member is formed either in whole or in part from a thermal insulation material.

15. The fixing device according to claim 14, wherein the thermal insulation material includes one of poly-etheretherketone (PEEK), polyimide (PI), polyamideimide (PAI), polybenzimidazole (PBI), polytetrafluoroethylene (PTFE), or perfluoro alkoxyl alkane (PEA).

16. The fixing device according to claim 11, wherein the thickness of said reinforcing member is thicker than the thickness of said support member.

17. A fixing device, comprising:

an endless loop shaped heating member;

a heating source being disposed within said heating member;

a support member having a contact surface contacting an inside surface of said heating member;

a pressure member contacting a part of said heating member corresponding to a part contacting said contact surface of said support member; and a reinforcing member reinforcing said support member, said support member supporting said reinforcing member by support portions formed by cutting out and bending parts of said support member to form cutout parts and said support portions.

18. The fixing device according to claim 17, wherein each cutout part has one support portion.

19. The fixing device according to claim 18, wherein said support portions are arranged on alternate sides of said cutout parts.

20. The fixing device according to claim 17, wherein each cutout part has two support portions.

* * * * *